US007000336B2

(12) United States Patent
Leitner

(10) Patent No.: US 7,000,336 B2
(45) Date of Patent: Feb. 21, 2006

(54) TRAINING SHOE, IN PARTICULAR SKI-SHOE

(75) Inventor: Johann Leitner, Bichlbach (AT)

(73) Assignee: Aulei Leitner & Auer Oeg, Steinach Am Brenner (AU)

( * ) Notice: Subject to any disclaimer, the term of this patent is extended or adjusted under 35 U.S.C. 154(b) by 0 days.

(21) Appl. No.: 10/950,895

(22) Filed: Sep. 24, 2004

(65) Prior Publication Data

US 2005/0060916 A1 Mar. 24, 2005

Related U.S. Application Data

(63) Continuation of application No. PCT/AT03/00083, filed on Mar. 25, 2003.

(30) Foreign Application Priority Data

Mar. 26, 2002 (AT) ..... A 470/2002

(51) Int. Cl.
*A43B 5/04* (2006.01)
*A43C 9/08* (2006.01)
*A43C 9/00* (2006.01)

(52) U.S. Cl. ..... 36/117.1; 36/117.2; 280/617

(58) Field of Classification Search ..... 36/117.1, 36/115, 117.2, 132; 280/611, 612, 617, 618
See application file for complete search history.

(56) References Cited

U.S. PATENT DOCUMENTS

| | | | | |
|---|---|---|---|---|
| 4,543,738 | A | 10/1985 | Mower | |
| 4,864,739 | A * | 9/1989 | Maestri | 36/117.2 |
| 4,941,274 | A * | 7/1990 | Janos et al. | 36/117.2 |
| 5,293,702 | A | 3/1994 | Miyoshi et al. | |
| 5,634,284 | A | 6/1997 | MacPhail | |
| 2002/0178615 | A1 * | 12/2002 | Saillet et al. | 36/117.2 |

FOREIGN PATENT DOCUMENTS

| | | | |
|---|---|---|---|
| DE | 4229039 | A1 * | 4/1993 |
| DE | 4138801 | | 5/1993 |
| DE | 4303189 | | 8/1994 |
| EP | 341822 | A2 * | 11/1989 |
| EP | 356400 | * | 2/1990 |
| FR | 2806884 | | 10/2001 |
| WO | WO 92/18211 | * | 10/1992 |
| WO | WO 93/10681 | * | 6/1993 |
| WO | WO 9318676 | | 9/1993 |

* cited by examiner

*Primary Examiner*—Anthony Stashick
(74) *Attorney, Agent, or Firm*—Martin Fleit; Paul D. Bianco; Fleit Kain Gibbons Gutman Bongini & Bianco P.L.

(57) ABSTRACT

A sports boot, in particular a ski boot, which is capable of being connected to a sports tool, e.g. a ski, movable along the ground, wherein the center of the pad axis is located between the longitudinal axis of the sports ski and the inner edge of the ski. The axis of symmetry (S1) of the shell is rotated by an angle ($\alpha$) relative to the axis of symmetry (S2) of the sole plate (2) so that the center of the heel is located between the axis of symmetry (SX) of the ski and the inner edge (Ki) of the ski.

12 Claims, 3 Drawing Sheets

TRAINING SHOE, IN PARTICULAR SKI-SHOE

RELATED APPLICATION

This application is a continuation of International Application No. PCT/AT03/00083 filed Mar. 25, 2003, the contents of which are here incorporated by reference in their entirety; Applicant claims the benefit of 35 USC Sec. 120.

BACKGROUND OF THE INVENTION

1. Field of the Invention

The invention relates to a sports boot, and in particular relates to a ski boot capable of being connected to a ski movable along the ground.

2. Prior Art

Today, in many modern types of sports, such as, e.g., in alpine skiing, cross-country skiing, speed skating, inline skating etc., sports boots made of a stiff, resistant material are used which, in the toe and heel regions thereof, are provided with connecting pieces usually integrated in the sole of the boot, so that a stable and, in respect of the particular type of sports practiced, functional connection to the sports tool, such as, e.g., the ski, can be achieved by means of mechanical elements, such as, e.g., the ski binding.

As a rule, these boots consist of a shell embracing the foot, as well as a sole plate. These two units may either be produced in one piece, e.g. by injection molding from a synthetic material, or if made of several parts, they may be mechanically interconnected, e.g. by screwing, riveting, gluing or the like. In ski boots, the sole plate and the shell usually are built up symmetrically to each other with regard to their longitudinal axes. This means that the natural V-position of the healthy human foot in a comfortable, relaxed standing manner is forced into a parallel guide on the ski, resulting in a rotation in the knee joint when setting the ski on edge, and accordingly the direction of load in the bone axes, thigh-bone and shin-bone, will no longer extend exactly linearly, but rather via angularities, resulting in possible knee in-juries and fatigue symptoms, and also not optimally ensuring the performance of skiing.

FIG. 2 shows a conventional boot with symmetrical construction of the shell 1, wherein the axis of symmetry of the sole plate and the axis of symmetry SX of the ski 3 are congruent. It is clearly visible that the centre of gravity of the pad BS is located between the axis of symmetry SX of the ski 3 and the outer edge Ka of the ski 3.

This construction causes an undesired pressure on the outer edge.

To improve this problem, a boot construction has been proposed in EP 0 634 900 B1, in which the connecting line between the center of the heel and the center of the sole arch accommodating the big toe extends in parallel to the movement direction of the ski. In ski boot constructions of this type, however, the center of gravity of the pad, which is defined by the center of the axis of the pad, also comes to lie between the longitudinal axis of the ski and the outer edge of the ski as is generally the case in ski boots of symmetrical construction. By this, a counter-productive behavior to skiing is achieved, since due to this position of the center of gravity of the pad, an increased pressure is exerted on the outer edge of the ski, the former acting against the desired direction of movement of the ski.

From DE 41 38 801 A and DE 43 03 189 A, ski boots with a shell and a sole have become known, wherein the shell encloses an angle with the sole. In this case, the heel is located within the middle of the ski and the inner edge of the ski. In these known ski boots, particularly during alpine skiing, difficulties have occurred when initiating a turn with the skis, in particular if the bottom ski is set on edge via its inner edge, since the position of the center of gravity of the pad has not been taken into consideration. Since the nerve strands meet in the region of the pad, the center of gravity of the pad is of particular importance from biomechanical points of view for triggering movements, in particular for directing skis.

SUMMARY OF THE INVENTION

In a sports boot of the initially defined type, this problem is solved according to the invention by the measures described hereinafter.

For, it has been shown that when the center of gravity of the pad is located between the longitudinal axis of the ski and the outer edge of the ski, the introduced force acts precisely in counter-direction to setting the ski on edge when initiating a turn, which leads to a late reaction and to a poor traveling behavior.

By the measures according to those described herein, the initiation of a turn is accelerated, resulting in a particular advantage for top sports.

BRIEF DESCRIPTION OF THE DRAWINGS

In the following, the invention will be explained in more detail by way of the drawings.

DETAILED DESCRIPTION OF PREFERRED EMBODIMENTS OF THE INVENTION

Figure 1:
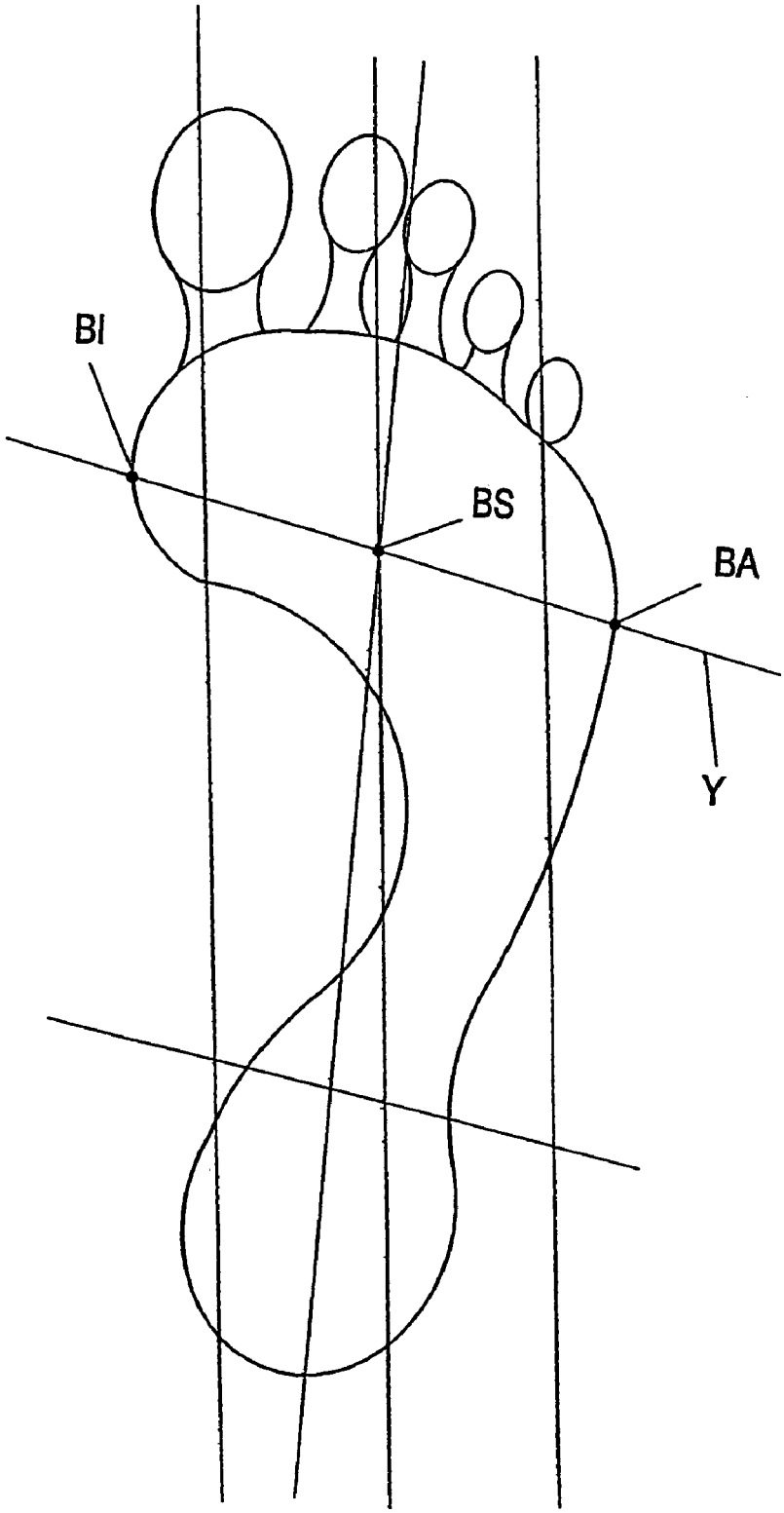
FIG. 1 shows the imprint of a healthy human foot.
Figure 2:
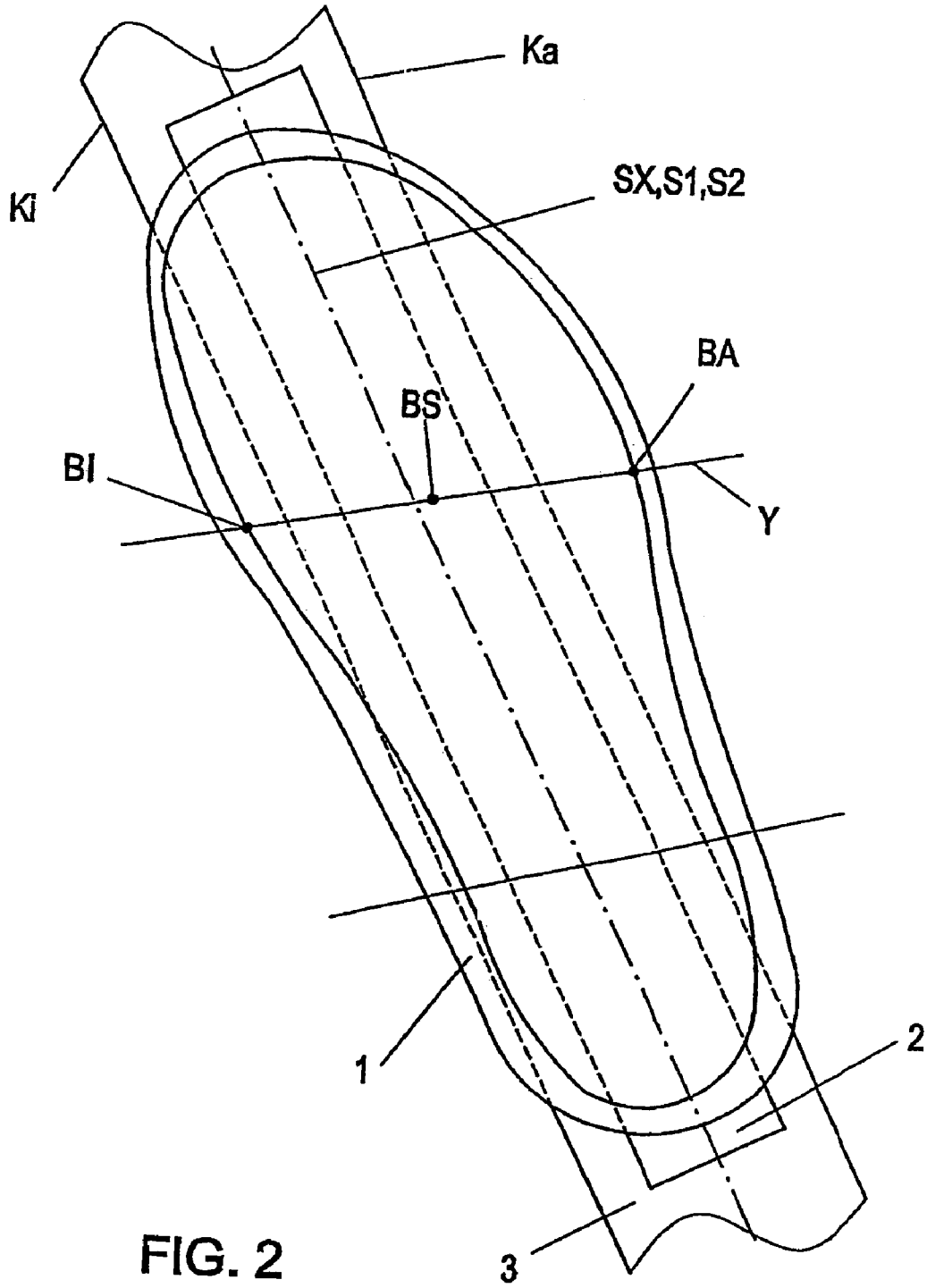
FIG. 2 shows a conventional boot with symmetrical construction of the shell 1.

In FIG. 1, Y denotes the axis of the pad that is delimited by point BA at the outer side of the pad and by point BI at the inner side of the pad. BS denotes the center of gravity of the pad, which divides the distance BA–BI into two halves.

Figure 3:
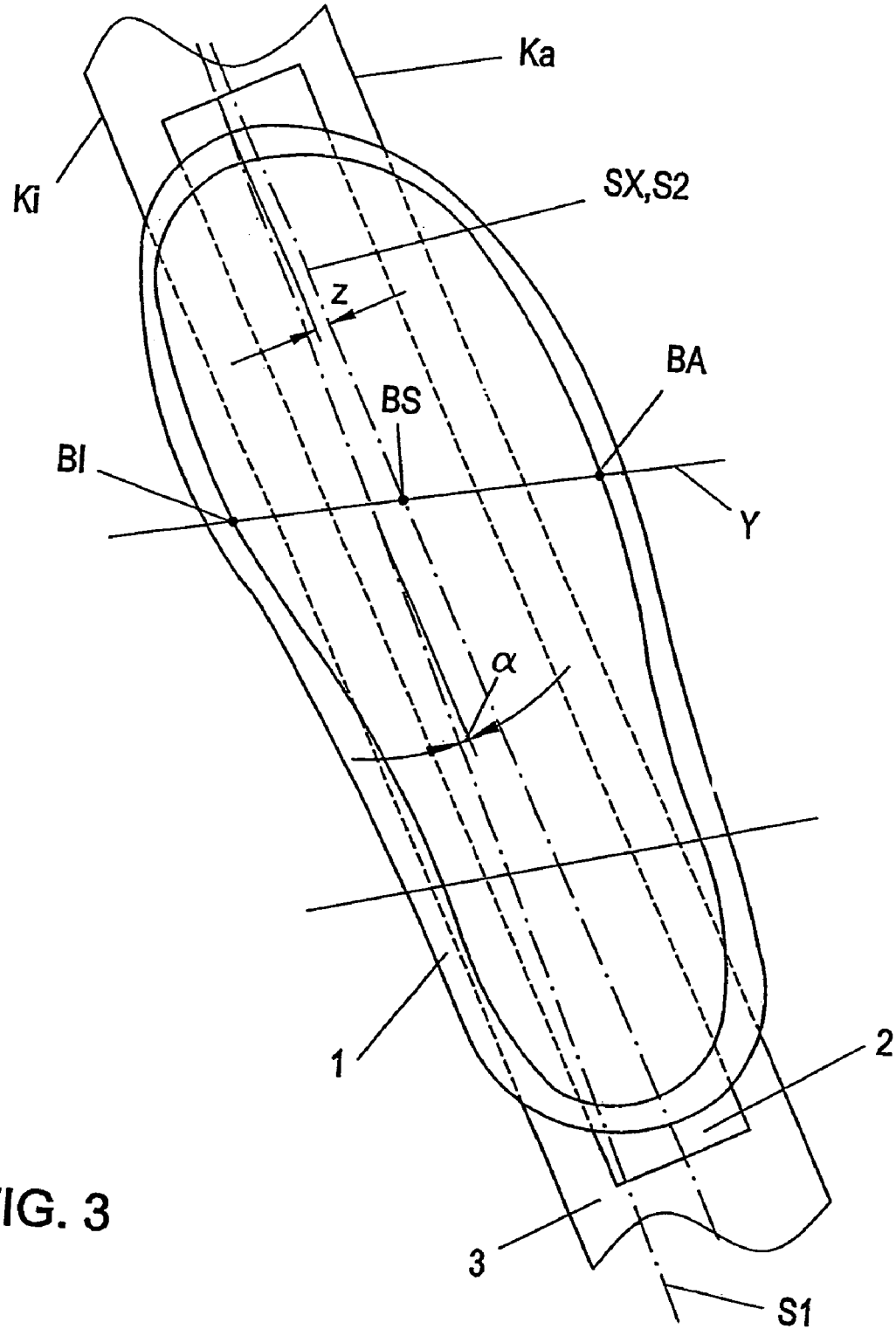
FIG. 3 shows an embodiment of the boot according to the invention, wherein for a better understanding of the invention, the known boot according to FIG. 2 is illustrated and the axis of symmetry SI of the boot according to the invention has been entered.

In FIG. 3, SX denotes the axis of symmetry of ski 3 that is congruent with the axis of symmetry S2 of the sole plate of the boot, whereby the perfect functioning of the ski binding remains ensured.

The axis of symmetry S1 of the shell 1 is rotated by an angle $\alpha$ relative to the axis of symmetry S2 of the sole plate 2 so that the center of the heel comes to lie between the axis of symmetry SX of ski 3 and the inner edge Ki of ski 3. FIG. 3 also illustrates the outer edge Ka of ski 3.

In addition, the axis S1 is inwardly offset by an amount z in the toe region, whereby the center of gravity of the pad BS is located on the axis of symmetry SX of ski 3.

This construction causes a particularly neutral traveling behavior.

If the amount z is increased, the center of gravity of the pad BS increasingly moves towards the inner edge Ki of ski 3. Thus, a more direct initiation of a turn is achieved which is of particular advantage in top sports.

What is claimed is:

1. A sports boot comprising:

a shell for embracing a human foot, the shell having an axis of symmetry; and a sole plate connected with the shell, the sole plate having an axis of symmetry and the sole plate having toe and heel connecting sections, wherein the axis of symmetry of the shell is offset a first distance from the axis of symmetry of the sole plate at the tip of the toe connecting section, and wherein the axis of symmetry of the shell is angled relative to the axis of symmetry of the sole plate such that the first distance is less than a second distance measured between the axis of symmetry of the shell and the axis of symmetry of the sole plate at the tip of the heel connecting section, the first and second distances being on the same side of the axis of symmetry of the sole plate.

2. The sports boot of claim 1, wherein the shell is configured for embracing the left foot and wherein the axis of symmetry of the shell is offset to the right of the axis of symmetry of the sole plate at the tip of the toe connecting section.

3. The sports boot of claim 1, wherein the shell is configured for embracing the right foot and wherein the axis of symmetry of the shell is offset to the left of the axis of symmetry of the sole plate at the tip of the toe connecting section.

4. The ski boot of claim 1, wherein the shell includes a pad region defined between outer and inner sides of the shell configured for embracing the ball-of-the-foot, the pad region including a midpoint located equidistant between the outer and inner sides of the shell.

5. The ski boat of claim 4, wherein the midpoint of the pad is located on the axis of symmetry of the sole plate.

6. The ski boot of claim 4, wherein the midpoint of the pad is offset a third distance from the axis of symmetry of the sole plate, the first, second, and third distances being on the same side of the axis of symmetry of the sole plate.

7. The ski boot of claim 6, wherein the shell is configured for embracing the left foot and wherein the first, second, and third distances are on the right side of the axis of symmetry of the sole plate.

8. The ski boot of claim 6, wherein the shell is configured for embracing the right foot and wherein the first, second, and third distances are on the left side of the axis of symmetry of the sole plate.

9. The ski boot of claim 1, wherein the sole plate is configured for releasable attachment to a ski, the ski having an axis of symmetry and an inner edge.

10. The ski boot of claim 9, wherein the shell includes a pad region defined between outer and inner sides of the shell configured for embracing the ball-of-the-foot, the pad region including a midpoint located equidistant between the outer and inner sides of the shell.

11. The ski boot of claim 10, wherein the midpoint of the pad region is located on the axis of symmetry of the ski.

12. The ski boot of claim 10, wherein the midpoint of the pad region is located between the axis of symmetry of the ski and the inner edge of the ski.

* * * * *